US005954391A

United States Patent [19]

Gray

[11] Patent Number: 5,954,391

[45] Date of Patent: Sep. 21, 1999

[54] STABLE THREE LEGGED FOLDING CHAIR

[76] Inventor: Donald F. Gray, 5995 Seymour Rd., Owosso, Mich. 48867

[21] Appl. No.: 09/073,480

[22] Filed: May 6, 1998

Related U.S. Application Data

[60] Provisional application No. 60/046,673, May 16, 1997.

[51] Int. Cl.[6] ..... A47C 4/00

[52] U.S. Cl. ..... 297/58; 297/16.1; 297/55

[58] Field of Search ..... 297/16.1, 50, 55, 297/58, 59

[56] References Cited

U.S. PATENT DOCUMENTS

| | | | |
|---|---|---|---|
| D. 137,434 | 3/1944 | Angell . | |
| D. 155,273 | 9/1949 | Eames . | |
| D. 183,478 | 9/1958 | Cohen . | |
| 1,296,905 | 3/1919 | Barker . | |
| 1,314,830 | 9/1919 | Parsons . | |
| 2,346,989 | 4/1944 | O'Brien . | |
| 2,380,437 | 7/1945 | Homrighausen | 297/55 |
| 2,480,402 | 8/1949 | Elston . | |
| 2,629,429 | 2/1953 | Baumfeld et al. | 155/142 |
| 2,918,114 | 12/1959 | Hendrickson | 297/55 |
| 2,941,814 | 6/1960 | Mihalyi | 297/16.1 X |
| 3,420,571 | 1/1969 | Moore . | |
| 3,638,538 | 2/1971 | Sullivan . | |
| 3,802,734 | 4/1974 | Lindley . | |
| 3,997,213 | 12/1976 | Smith et al. . | |
| 4,014,591 | 3/1977 | Gittings | 297/55 |
| 4,047,752 | 9/1977 | Rohr . | |
| 4,676,548 | 6/1987 | Bradbury . | |
| 4,836,938 | 6/1989 | Kobasic . | |
| 4,889,387 | 12/1989 | Gregory . | |
| 5,016,792 | 5/1991 | Jay . | |
| 5,332,283 | 7/1994 | Gray | 297/58 |
| 5,478,138 | 12/1995 | Yu | 297/16.1 X |

*Primary Examiner*—Peter M. Cuomo
*Assistant Examiner*—Stephen Vu
*Attorney, Agent, or Firm*—Reising, Ethington, Barnes, Kisselle, Learman & McCulloch, P.C.

[57] ABSTRACT

The three-legged folding chair has a primary frame with two legs and an apex, a secondary frame with two arms and an apex, and a third leg. The secondary frame is pivotally attached to the primary frame by two pivot pins. A back rest is secured to the primary frame adjacent to the primary frame apex. A support seat is attached to the arms of the secondary frame and are spaced from the secondary frame apex. The third leg is connected to the backrest adjacent to the primary frame apex. The apex of the secondary frame is held in a use position by the third leg. The secondary frame intersects the primary frame at an angle of about 66° when held by the third leg. Both pivot pins are held out of axial alignment with each other when in the use position. The ground contact ends of the primary frame legs are under the forward edge of the support seat, the third leg is relatively short and weight is transferred to the third leg. The backrest is spaced forwardly from the primary frame apex.

6 Claims, 3 Drawing Sheets

STABLE THREE LEGGED FOLDING CHAIR

This application claims benefit of Provisional Appln. No. 60/046,673 filed May 16, 1997.

TECHNICAL FIELD

This invention is in a three legged folding chair for outdoor use and more particularly in a three legged folding chair with improved stability.

BACKGROUND OF THE INVENTION

Hunters, ice fishermen and others engaged in outdoor activities need lightweight chairs that can be carried substantial distances and that can be used on uneven and slopping surfaces. The chair is an improvement over the three legged folding chair shown in my U.S. Pat. No. 5,332,283.

Chairs with three legs can sit on uneven surfaces without rocking while rigid chairs with four or more legs will rock unless the surface upon which they are supported is flat. However, a chair with three legs is generally less stable than a chair with four legs that is about the same size.

The stability of a chair can generally be improved by moving the support seat for a person closer to the ground or by increasing the space between the contact surfaces on the bottom of the three legs. Lowering the support seat makes the chair less comfortable when sitting for long periods of time as well as increasing the time and effort required to stand and move into action when a fish takes a hook or an animal being hunted appears.

Spreading the contact surfaces on the bottom of three legs improves stability. However, this change increases chair weight and size making it more difficult to transport the chair in a folded condition. Since a hunter or fisherman has equipment to carry in addition to a chair, the chair should be as light as possible without unduly sacrificing strength or durability. The size of the chair in the folded condition must be sufficiently small to minimize catching on trees, vines, bushes, and other obstructions. Ideally a folding chair, when being transported in a folded condition on a person's back would not extend up above the person's head, out past the person's shoulders or down to a position in which contact with a person's legs would occur. Obviously a chair which exceeds such dimensions slightly would not normally be a problem. However, the further a folded chair being transported on a person's back extends out past his sides, up above his head, or down toward his legs, the more likely the chair is to catch on obstructions while being carried.

Metal structures may be weakened by holes that are drilled through them. Reducing the number of holes and the size of holes that pass through the frame members of a lightweight folding chair, reduces the possibility of frame failures and permits chair weight to be minimized.

SUMMARY OF THE INVENTION

An object of the invention is to provide a chair with three legs that has improved stability.

Another object of the invention is to provide a chair with three legs that has a molded back rest and a molded seat.

A further object of the invention is to provide a folding chair with pivot pins that bind and tighten as the secondary frame approaches a use position.

The folding chair has a primary frame formed by bending an aluminum tube into a V-shaped structure. The V-shaped structure has a right leg, a left leg and an apex. A secondary frame includes a V-shaped structure formed by bending an aluminum pipe. The secondary frame has an apex, a right arm, and a left arm.

Right and left pivot pins pass through bores through the arms and the legs of the primary and secondary frames and pivotally attach the frames together. Adjacent ends of the bores through the right arm and the right leg are slightly larger than the right pivot pin. The ends of bores through the right arm and the right leg that are adjacent to the ends of the right pivot pin are substantially larger than the diameter of the right pivot pin. The left pivot pin passes through bores through the left arm and the left leg that are the same as the bores through the right arm and the right leg. The large diameter ends of the bores through the arms and legs of the primary frame and the secondary frame are however sufficiently small to insure that the right pivot pin and the left pivot pin cannot move into axial alignment with each other. As a result when the secondary frame pivots relative to the primary frame from a folded position to a use position, the right and left pivot pins tighten in the bores and movement of the secondary frame relative to the primary frame is limited.

An injection molded plastic back rest is attached to the primary frame adjacent to the primary frame apex by mechanical fasteners. Posts integral with the back rest position the back rest back contact surface away from the primary frame apex and place a portion of the back contact surface in a plane that intersects the right leg and the left leg of the primary frame. This moves the primary frame further away from the vertical position than earlier chairs while supporting a person using the chair in a generally upright position. The ground or floor contact ends of the legs of the primary frame are moved forward relative to the back rest and chair stability is increased.

An injection molded support seat is attached to the free ends of the right and left arms of the secondary frame. The support seat extends from a forward edge to a rear edge adjacent to the pivot assemblies connecting the primary and secondary frame to each other.

A third leg is pivotally attached between two post members integral with the back rest and in contact with the apex of the primary frame. A spring clip member, secured to a mid portion of the third leg, holds the apex of the secondary frame in a fixed position relative to the primary frame when the chair is in a use position. The spring member deforms to release the apex of the secondary frame and allows the chair to be placed in a folded position for transport or storage. The third leg is forced into a clip on the bottom of the support seat when the chair is folded. This clip holds the third leg in a fixed position relative to the primary and secondary frames.

Pivoting the secondary frame relative to the primary frame between the use position and the folded position moves the secondary frame about 70° relative to the primary frame. However, the secondary frame may be pivoted between about 60° and about 73° depending upon the angle of the primary frame relative to a horizontal plane and the position of the back rest back contact surface relative to the primary frame apex.

DESCRIPTION OF THE PREFERRED EMBODIMENT

Figure 2:
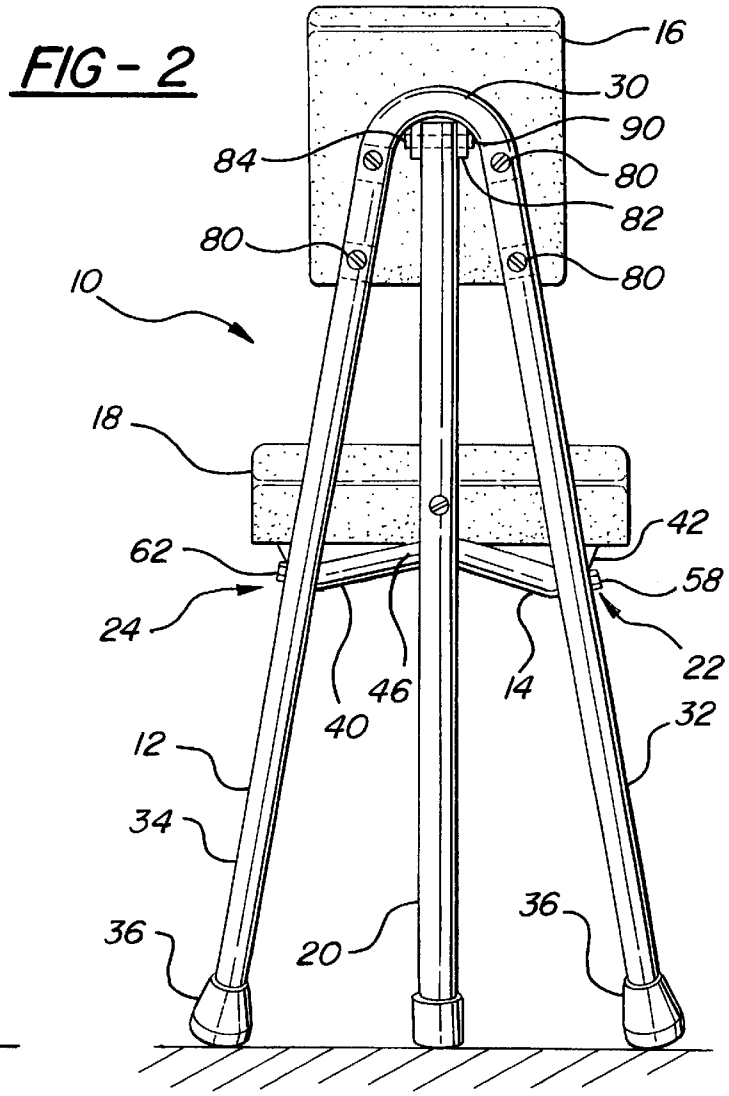
FIG. 2 is a rear elevational view of the chair.

The folding chair generally designated 10 for campers, hunters, fishermen and others includes a primary frame 12, a secondary frame 14, a back rest 16, a support seat 18 and a third leg 20. The back rest 16 is attached to the primary frame 12. The support seat 18 is attached to the secondary frame 14. A pair of pivot assemblies 22 and 24 pivotally attached the secondary frame 14 to the primary frame 12. A third leg 20 is pivotally connected to the back rest 16 and is releasably attached to the secondary frame 14 to hold the chair in a use position.

The primary frame 12 of the chair 10 is a tubular member 28 bent generally into a V-shape with an apex 30, a right leg 32 and a leg 34. Rubber or plastic caps 36 are placed on the free ends of the right and left legs 32 and 34 to protect floor surfaces and to close the open ends of the tubular member 28. The caps 36 also keep mud and dirt from being forced into the inside of the tubular member 28 when the chair 10 is used outside on the ground. The free ends of the right and left legs 32 and 34 both have forward bends 38 that move the caps 36 forward to increase stability. This allows a person to sit on the forward edge support seat 18 when the chair is on a level surface.

The secondary frame 14 is a tubular member 40 bent generally into a V-shape with a right arm 42 and a left arm 44 joined together at an apex 46. The right arm 42 and the left arm 44 have slight bends 48 that raise the apex 46 from a plane through the center of the right arm and the left arm. The purpose of this bend is explained below.

Pivot assemblies 22 and 24 pivotally connect the secondary frame 14 to the primary frame 12. Both pivot assemblies 22 and 24 are substantially the same. Only the right pivot assembly 22 will therefore be described. Inside apertures 50 and outside apertures 52 are drilled through the right leg 32. Inside apertures 54 and outside apertures 56 are drilled through the right arm 42. The inside apertures 50 and 54, which are adjacent to each other, are slightly larger in diameter than the right pivot pin 58. The outside aperture 52, which is adjacent to one end of the pivot pin 58 and is larger in diameter than the inside aperture 50, cooperates with the inside aperture to form a conical passage through the right leg 32. The outside aperture 56, which is adjacent to the other end of the right pivot pin 58 is larger in diameter than the inside aperture 54, cooperates with the inside aperture to form a conical passage through the right arm 42.

The actual pivot axis 60 of the secondary frame 14 relative to the primary frame 12 passes through the center of both inside apertures 50 and 54 of both pivot assemblies 22 and 24. The conical passages that result from the larger diameter outside apertures 52 and 56 allow the right pivot pin 58 and the left pivot pin 62 to float. The outside apertures 52 and 56 are preferably sized so that the pivot pin 58 or 62 cannot move into axial alignment with the actual pivot axis. The outside aperture 52 is offset relative to the inside aperture 50 toward the free end and the cap 36 of the primary frame 12. The outside aperture 56 is offset relative to the inside aperture 54 toward the apex 56 of the secondary frame 14. These offsets of the outside apertures 52 and 56 make it possible to reduce the diameter of the outside apertures while still accommodating pivotal movement of the secondary frame 14 relative to the primary frame 12. Reducing the diameter of the outside apertures 52 and 56 strengthens both the primary and the secondary frames 12 and 14. By carefully selecting the diameter and positions of the outside apertures, the right and left pivot pins 58 and 62 are loose when the chair is in a folded position and they are wedged and tight when the chair is in a use position. Tightening the right and left pivot pins 58 and 62 when the chair 10 is in the use position reduces wear in the right and left and pivot assemblies 22 and 24. Washers 64 are provided between the right leg 32 and the right arm 42 and between the left leg 34 and the left arm 44 to center the secondary frame 14 between the right leg and the left leg of the primary frame 12. However it would be possible to increase the size of the secondary frame 14 and place the primary frame 12 between the arms 42 and 46 of the secondary frame 14. A larger secondary frame 14 would be expected to increase the weight of the chair without a significant change in strength.

Figure 3:
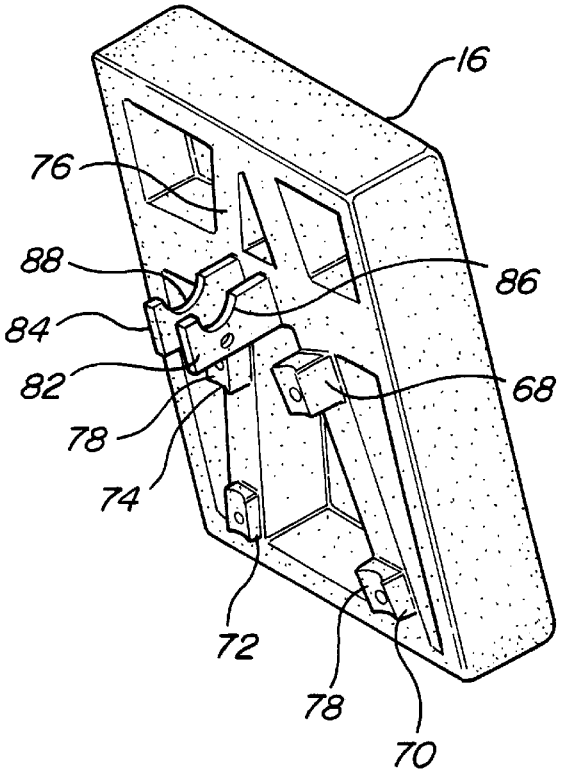
FIG. 3 is a perspective view of the back rest.

The back rest 16 is an injection molded member. It has a smooth back rest surface 66. This back rest surface 66 could be curved if desired and it could also be padded for additional comfort. Reinforcement bars or ribs 76 are molded into the back rest 16 as shown in FIG. 3. Mounting bars 68, 70, 72 and 74 extend outward from the reinforcement ribs 76. The upper mounting bars 68 and 74 are substantially longer than the two lower mounting bars 70 and 72. These mounting bars 68, 70, 72 and 74 all have a contour primary frame mounting surface 78. Four screws 80 pass through the primary frame 12 adjacent to the apex 30, screw into the mounting bars 68–74 and clamp the primary frame against the frame mounting surface 78. Two third leg mounting bars 82 and 84 are molded with the reinforcement ribs 76. Both mounting bars 82 and 84 have arcuate recesses 86 and 88. The apex 30 of the primary frame 12 is received in the recesses 86 and 88. The recesses 86 and 88 should be shaped as required to make maximum contact with the primary frame 12. The upper end of the third leg 20 is positioned between the two mounting bars 82 and 84 and is retained in position by a fastener 90 that passes through the mounting bar 82, the third leg 20 and the mounting bar 84. Most of the load on the third leg 26 passes through the fastener 90 and the mounting bars 82 and 84 to the primary frame 12.

The support seat 18 is also a plastic injected molded member. The support seat 18 has a solid bottom wall 92 and integral reinforcement ribs (not shown) on the inside above the bottom wall. A padded seat cushion 94 is secured to the upper part of the support seat 18 by fasteners or adhesive and sits on the integral reinforcement ribs.

Attachment flanges 96 and 98 are integral with the bottom surface 100 of the solid bottom wall 92. The attachment flanges 96 and 98 have support surfaces that are contoured to receive and contact the arms 42 and 44 of the secondary frame 14. Four or more bolts 95 pass through the arms 42 and 44 of the secondary frame 14 and screw into the support seat 18. A plastic spring clip 102 is molded integral with the solid bottom wall 92 or is secured to the bottom wall. If the spring clip 102 is secured to the bottom wall it can be a spring steel member or a plastic member.

The apex 46 of the secondary frame 14 is forced into and releasably retained by the spring clip 104 attached to the mid portion of the third leg 20 by a bolt 106. The spring clip 104 holds the third leg 20 in a fixed position relative to the primary frame 12. A portion of the downward load on the support seat 18 is transferred to the third leg 20 through the clip 104 and exerts an upward force on the third leg.

Figure 1:
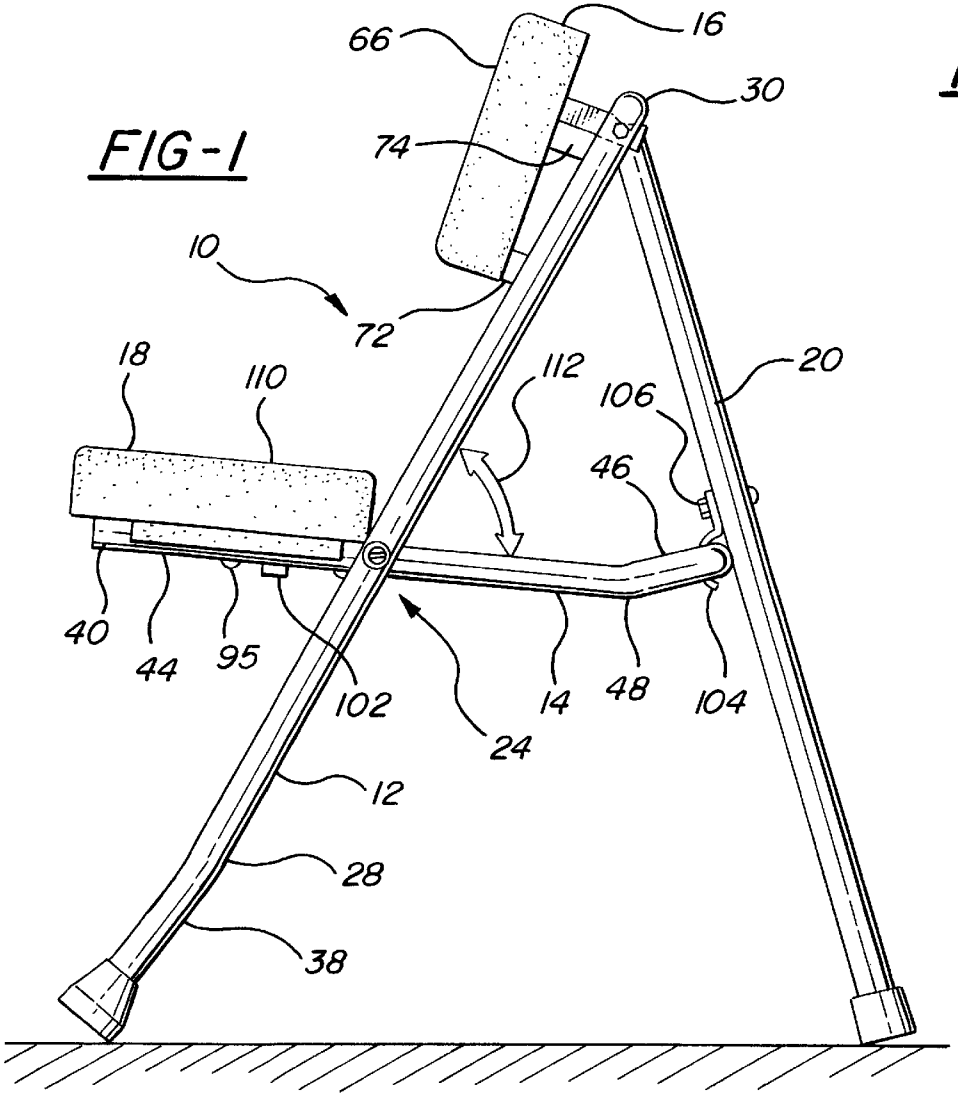
FIG. 1 is a side elevational view of the chair in a use position.
Figure 4:
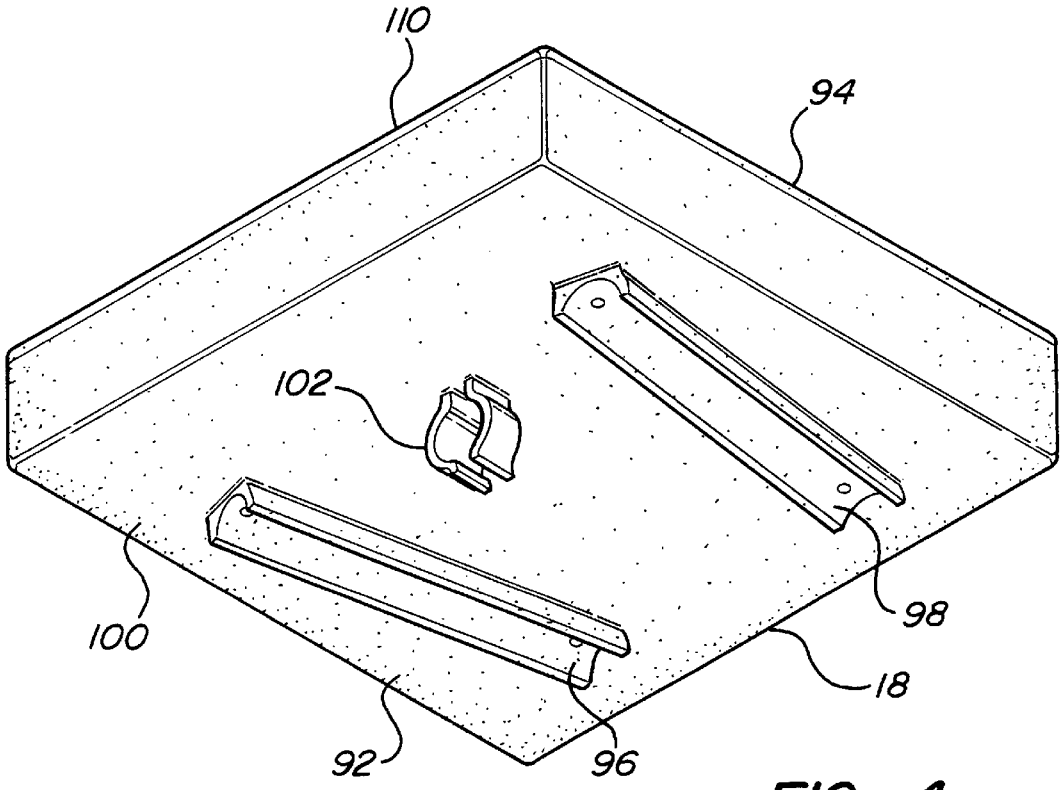
FIG. 4 is a perspective view of the support seat.
Figure 7:
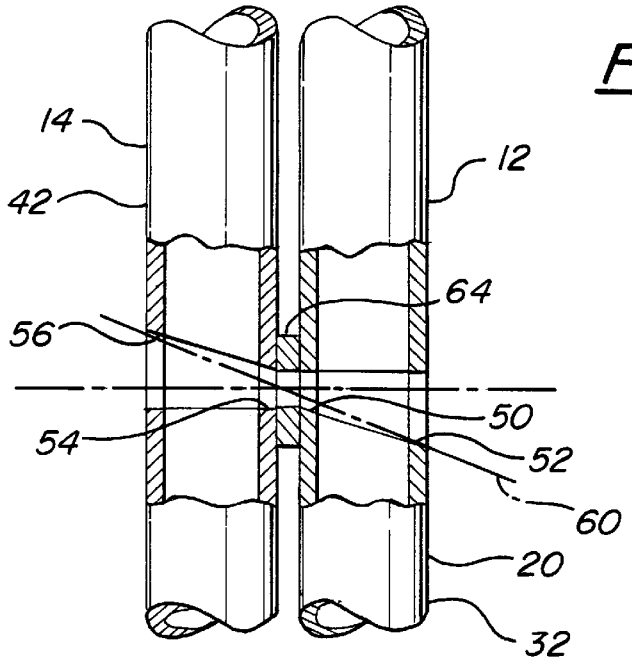
FIG. 7 is an enlarged sectional view of one of the pivot assemblies taken along line 7—7 in FIG. 6.
Figure 5:
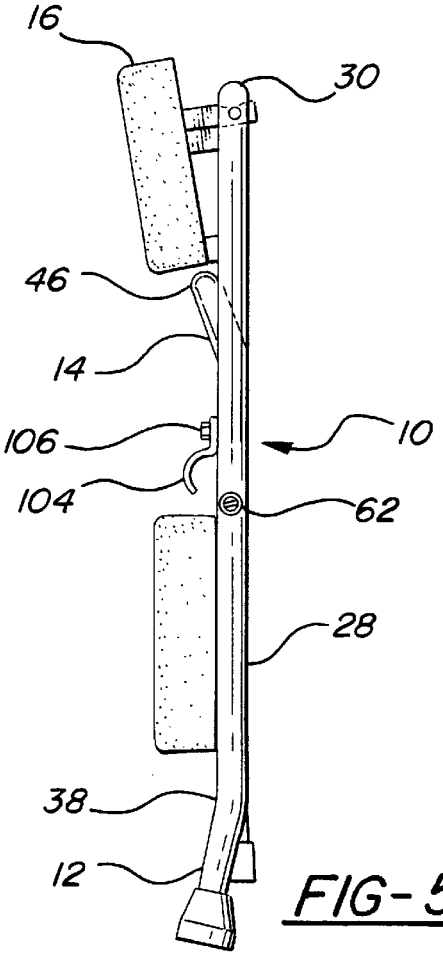
FIG. 5 is a side elevational view of the chair in a folded position.
Figure 6:
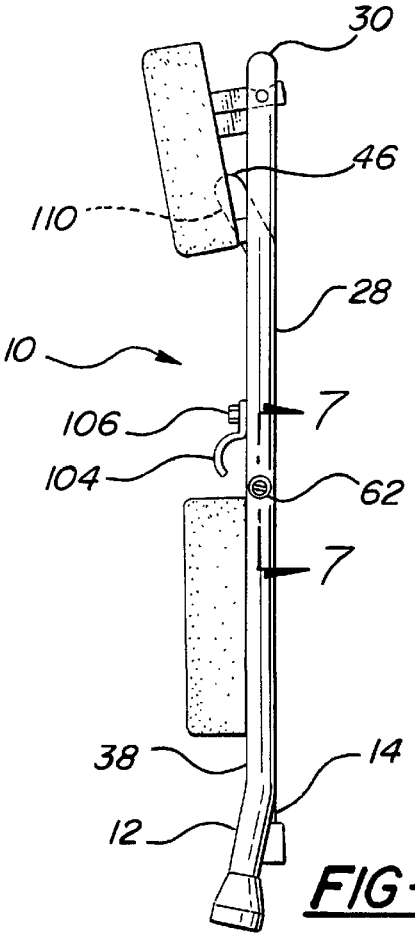
FIG. 6 is a side elevational view of a modified version of the chair.

The apex 46 of the secondary frame 14 is pushed out of the clip 104 to fold the chair 10 into a folded position as shown in FIGS. 5 and 6. The third leg 26 is then pivoted to the rear in a counterclockwise direction about the axis of the frame 90 as shown in FIG. 1 to a position that leaves the apex 30 of the secondary frame 14 free to pivot upward toward the apex 30 of the primary frame 12. The apex 46 of the secondary frame 14 pivots into a position adjacent to the rear side 108 of the back rest 16. If necessary, the apex 46 of the secondary frame 14 can move into a recess 110 in the back rest 16 as shown in FIG. 6. If the secondary frame is slightly longer, the bends 48 will allow the apex 46 to move adjacent to the rear of the back rest 16 and below the mounting bars 82 and 84. If the secondary frame 14 is shorter, as shown in FIG. 5, the apex 46 of the secondary frame 14 folds into a position below the back rest 16. After the apex 46 of the secondary frame 14 is forward of a plane tangent to the forward edges of the apex 30 of the primary frame 12, the third leg 20 pivots in between the right and left legs 32 and 34 and is retained by the spring clip 102 as shown in FIGS. 1 and 4. The chair 10 is held in a folded position until the third leg 20 is removed from the spring clip 102.

The back rest 16 could have a solid rear wall construction with hidden reinforcement ribs and an attached padded back rest similar to the support seat 18 described above. Conversely, the seat support 18 could have a molded support surface 110 and exposed reinforcement ribs (not shown) like the back rest 16 as described above.

The longer mounting bars 68 and 74 of the back rest 16, as described above, place the back rest surface 66 in a plane that intersects the right and left legs 32 and 34 of the primary frame 12. This allows the primary frame 12 to be tilted further toward a horizontal position than similar prior art chairs. This additional tilt of the primary frame 12 shifts the support seat 18 to the rear relative to the caps 36 on the free ends of the right and left legs 32 and 34. This increases the weight on the third leg 20 and improves stability. The chair 10 is also usable on terrain with more of a slope than prior art chairs.

Similar prior art chairs have a secondary frame that pivots through an angle 112 of about 75° or more when moving between a use position and a folded position. The secondary frame 14 of this chair 10 preferably pivots about 70° relative to the primary frame 12 to move from a use position to a folded position. Minor changes in the geometry of the chair 10 can change the range of movement of the secondary frame 14 relative to the primary frame 12 from about 73° to about 60°. The change in the position of the back rest surface 66 relative to the primary frame 12 also permits a reduction in the length of the third leg 20 or an increase in the overall height of the primary frame 12 without a corresponding increase in the length of the third leg.

The disclosed embodiment is representative of a presently preferred form of the invention, but is intended to be illustrative rather than definitive thereof. The invention is defined in the claims.

I claim:

1. A foldable multiple purpose chair comprising a primary frame that includes a generally V-shaped structure with a right leg and a left leg joined together at an apex; a secondary frame that includes a generally V-shaped structure with a right arm and a left arm joined together at an apex; a pivot assembly pivotally connecting the secondary frame to the primary frame that permits pivotal movement of the secondary frame relative to the primary frame between a folded position and a use position; said pivot assembly including a bore through the right leg, a bore through the right arm, a right pivot pin passing through the bores through the right leg and the right arm, a bore through the left leg, a bore through the left arm, and a left pivot pin which passes through the bores through the left leg and the left arm; a back rest attached to the primary frame adjacent to the primary frame apex and having a back rest surface a portion of which is in a plane that intersects the right leg and the left leg and wherein the back rest contact surface is spaced from the primary frame apex; a support seat attached to the right arm and the left arm of the secondary frame; a third leg pivotally attached to the primary frame adjacent to the apex of the primary frame with a third leg mid-section that is attached to the secondary frame apex to hold the secondary frame in a use position and wherein the third leg mid-section is released from the secondary frame apex to free the secondary frame to move to the folded position; wherein the secondary frame member pivots relative to the primary frame during movement from the use position to the folded position; and wherein the back rest has at least one mounting bar that holds an upper portion of the back rest surface away from the primary frame further than a lower portion of the back rest surface.

2. A foldable multiple purpose chair as set forth in claim 1 wherein the right pivot pin passes through at least one non-cylindrical passage, the left pivot pin passes through at least one non-cylindrical passage, and the right pivot pin and the left pivot pin are held out of axial alignment with each other when the chair is in the use position.

3. A foldable multiple purpose chair as set forth in claim 1 wherein the support seat has an edge farthest from the pivot assembly that is in a vertical plane when the chair is in the use position and the right leg and the left leg contact a chair support surface adjacent to the vertical plane.

4. A foldable multiple purpose chair as set forth in claim 1 wherein the secondary frame member pivots between 60° and 73° relative to the primary frame when moved from the folded position to the use position.

5. A foldable multiple purpose chair comprising a primary frame that includes a generally V-shaped structure with a right leg and a left leg joined together at an apex; a secondary frame that includes a generally V-shaped structure with a right arm and a left arm joined together at an apex; a pivot assembly pivotally connecting the secondary frame to the primary frame that permits pivotal movement of the secondary frame relative to the primary frame between a folded position in which the right and left arms are between the right and left legs, the right arm is generally parallel to the right leg, and the left arm is generally parallel to the left leg, and a use position; said pivot assembly including a bore through the right leg, a bore through the right arm, a right pivot pin passing through the bores through the right leg and the right arm, a bore through the left leg, a bore through the left leg, a bore through the left arm, and a left pivot pin which passes through the bores through the left leg and the left arm; a back rest attached to the primary frame adjacent to the primary frame apex and having a back rest surface a portion of which is in a plane that intersects the right leg and the left leg and wherein the back rest contact surface is spaced from the primary frame apex; a support seat attached to the right arm and the left arm of the secondary frame; a third leg pivotally attached to the primary frame adjacent to the apex of the primary frame with a third leg mid-section that is attached to the secondary frame apex to hold the secondary frame in a use position and wherein the third leg mid-section is released from the secondary frame apex to free the secondary frame to move to the folded position; the right pivot pin passes through an outside aperture in the right leg, an inside aperture in the right leg, an outside aperture in the right arm, and an inside aperture in the right arm; the left pivot pin passes through an outside aperture in the left leg, an inside aperture in the left leg, an outside aperture in the left arm, and an inside aperture in the left arm; the inside aperture in the right leg is adjacent to the outside aperture in the right arm, the outside aperture in the right leg is adjacent to an end of the right pivot pin and is larger than the inside aperture in the right leg, and the inside aperture in the right arm is adjacent to an other end of the right pivot pin and is larger than the outside aperture in the right arm; the inside aperture in the left leg is adjacent to the outside aperture in the left arm, the outside aperture in the left leg is adjacent to an end of the left pivot pin and is larger than the inside aperture in the left leg, and the inside aperture in the left arm is adjacent to an other end of the left pivot pin and is larger than the outside aperture in the left arm; and wherein the outside aperture in the right leg and inside aperture in the right arm are positioned relative to the inside aperture in the right leg and the outside aperture in the right arm and to the right pivot pin, and the outside aperture in the left leg and the inside aperture in the left arm are positioned relative to the inside aperture in the left leg and the outside aperture in the left arm and to the left pivot pin in positions which permit the right pivot pin and the left pivot pin to move into axial alignment with each other when the chair is in the folded position and which hold the right pivot pin and the left pivot pin out of axial alignment with each other when the chair is in the use position.

6. A foldable multiple purpose chair as set forth in claim 5 wherein the back rest has at least one mounting bar that holds an upper portion of the back rest surface away from the primary frame further than a lower portion of the back rest surface.

* * * * *